United States Patent [19]

Cook et al.

[11] Patent Number: 4,961,870

[45] Date of Patent: Oct. 9, 1990

[54] AZEOTROPE-LIKE COMPOSITIONS OF 1,1,2-TRICHLORO-1,2,2-TRIFLUOROETHANE,1,2-DICHLOROETHYLENE, AND ALKANOL HAVING 3 TO 7 CARBON ATOMS

[75] Inventors: Kane D. Cook, Buffalo; Chien C. Li, East Aurora; Rajat S. Basu; David P. Wilson, both of Williamsville, all of N.Y.

[73] Assignee: Allied-Signal Inc., Morristown, N.J.

[21] Appl. No.: 451,673

[22] Filed: Dec. 14, 1989

[51] Int. Cl.[5] ..... C11D 7/30; C11D 7/50

[52] U.S. Cl. ..... 252/171; 252/162; 252/170; 252/172; 252/364; 252/DIG. 9; 134/12; 134/38; 134/39; 134/40; 203/67

[58] Field of Search ..... 252/162, 170, 171, 172, 252/364, DIG. 9; 134/12, 38, 39, 40; 203/67

[56] References Cited

U.S. PATENT DOCUMENTS

| | | | |
|---|---|---|---|
| 3,455,835 | 7/1969 | Burt | 252/172 |
| 3,723,332 | 3/1973 | Barton | 252/171 |
| 3,903,009 | 9/1975 | Bauer et al. | 252/171 |
| 3,960,746 | 6/1976 | Gorski | 272/171 |
| 4,052,328 | 10/1977 | Figiel | 252/171 |
| 4,062,794 | 12/1977 | Figiel | 252/171 |
| 4,606,841 | 8/1986 | Basu et al. | 252/171 |
| 4,683,075 | 7/1987 | Wilson et al. | 252/171 |
| 4,790,955 | 12/1988 | Lund et al. | 252/364 |
| 4,803,009 | 2/1989 | Gorski | 252/171 |
| 4,804,493 | 2/1989 | Gorski | 252/172 |
| 4,808,331 | 2/1989 | Burt et al. | 252/172 |
| 4,877,545 | 10/1989 | Marchant | 252/171 |

FOREIGN PATENT DOCUMENTS

| | | |
|---|---|---|
| 325240A | 7/1989 | European Pat. Off. . |
| 34798 | 4/1981 | Japan . |
| 34799 | 4/1981 | Japan . |
| 109298 | 8/1981 | Japan . |
| 126376 | 7/1985 | Japan . |
| 1165697 | 6/1989 | Japan . |
| 1165698 | 6/1989 | Japan . |
| 1167400 | 7/1989 | Japan . |
| 1204999 | 8/1989 | Japan . |
| 2066840 | 7/1981 | United Kingdom . |

*Primary Examiner*—Paul Lieberman
*Assistant Examiner*—Kathleen Markowski
*Attorney, Agent, or Firm*—Melanie L. Brown; Jay P. Friedenson

[57] ABSTRACT

Azeotrope-like compositions comprising 1,1,2-trichloro-1,2,2-trifluoroethane; 1,2-dichloroethylene; and alkanol having 3 to 7 carbon atoms have utility as degreasing agents and as solvents in a variety of industrial cleaning applications including cold cleaning and defluxing a printed circuit boards.

12 Claims, No Drawings

AZEOTROPE-LIKE COMPOSITIONS OF 1,1,2-TRICHLORO-1,2,2-TRIFLUOROETHANE,1,2-DICHLOROETHYLENE, AND ALKANOL HAVING 3 TO 7 CARBON ATOMS

FIELD OF THE INVENTION

The present invention relates to azeotrope-like compositions of 1,1,2-trichloro-1,2-trifluoroethane; 1,2-dichloroethylene; and an alkanol having 3 to 7 carbon atoms. These azeotrope-like compositions are useful in a variety of vapor degreasing, cold cleaning, and solvent cleaning applications including defluxing.

CROSS-REFERENCE TO RELATED APPLICATION

Co-pending, commonly assigned patent application Ser. No. 278,404 filed Dec. 1, 1988 discloses azeotrope-like compositions of 1,1,2-trichloro-1,2,2-trifluoroethane; 1,2-dichloroethylene; methanol; 1-chloropropane; and nitromethane.

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists Of exposing a room temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al. in U.S. Pat. No. 3,085,918 disclose such suitable vapor degreasers comprising a boiling sump, a clean sump, a water separator, and other ancillary equipment.

Cold cleaning is another application where a number of solvents are used. In most cold cleaning applications, the soiled part is either immersed in the fluid or wiped with rags or similar objects soaked in solvents and allowed to air dry.

Fluorocarbon solvents, such as trichlorotrifluoroethane, have attained widespread use in recent years as effective, nontoxiC, and nonflammable agents useful in degreasing applications and other solvent cleaning applications. Trichlorotrifluoroethane has been found to have satisfactory solvent power for greases, oils, waxes and the like. One isomer of trichlorotrifluoroethane is 1,1,2-trichloro-1,2,2-trifluoroethane (known in the art as CFC-113) It has therefore found widespread use for cleaning electric motors, compressors, heavy metal parts, delicate precision metal parts, printed circuit boards, gyroscopes, guidance systems, aerospace and missile hardware, aluminum parts and the like.

The art has looked towards azeotropic compositions including the desired fluorocarbon components such as trichlorotrifluoroethane which include components which contribute additionally desired characteristics, such as polar functionality, increased solvency power, and stabilizers. Azeotropic compositions are desired because they do not fractionate upon boiling. This behavior is desirable because in the previously described vapor degreasing equipment with which these solvents are employed, redistilled material is generated for final rinse-cleaning. Thus, the vapor degreasing system acts as a still. Unless the solvent composition exhibits a constant boiling point, i.e., is an azeotrope or is azeotrope-like, fractionation will occur and undesirable solvent distribution may act to upset the cleaning and safety of processing. Preferential evaporation of the more volatile components of the solvent mixtures, which would be the case if they were not an azeotrope or azeotrope-like, would result in mixtures with changed compositions which may have less desirable properties, such as lower solvency towards soils, less inertness towards metal, plastic or elastomer components, and increased flammability and toxicity.

U.S. Pat. No. 3,455,835 discloses an azeotropic composition of about 54 to about 64 percent by weight of 1,1,2-trichloro-1,2,2-trifluoroethane and from about 36 to about 46 percent by weight of trans-1,2-dichloroethylene. This teaching does not suggest the present azeotrope-like composition because as is known in the art, it is difficult to predict if another component will form a new azeotrope with a known azeotrope.

Another example is taught in U.S. Pat. No. 4,767,561. The disclosed composition comprises from about 4 to about 72 percent by weight of 1,1,2-trichloroethane-1,2,2-trifluoroethane; from about 23 to about 29 percent by weight of trans-1,2-dichloroethylene; and from about 5 to about 7 percent by weight of methanol.

While azeotropic or azeotrope-like compositions are useful as cleaning solvents, the azeotrope-like compositions should be stabilized against possible changes during storage and use. One potential change is due to chlorofluorocarbons such as trichlorotrifluoroethane hydrolyzing to form HCl. When metallic materials are present such as occurs in many cleaning applications, the problem is worsened because the metal acts as a catalyst and causes the hydrolysis of trichlorotrifluoroethane to increase expotentially. Metallic materials such as Al-2024, copper, cold rolled steel, galvanized steel, and zinc are commonly used in cleaning apparatus. Another potential change is due to ultraviolet light decomposing chlorofluorocarbons such as trichlorotrifluorocarbons.

One example of a stabilized azeotrope-like composition is taught in U.S. Pat. No. 4,804,493. The disclosed composition comprises from about 54 to about 64 percent by weight of 1,1,2-trichloro-1,2,2-trifluoroethane and from about 36 to about 46 percent by weight of trans-1,2-dichloroethylene and effective stabilizing amounts of 4-methoxyphenol: 1,2-butylene oxide; and nitromethane.

Another example of a stabilized azeotrope-like composition is taught in U.S. Pat. No. 4,803,009. The disclosed composition comprises from about 64 to about 72 weight percent of 1,1,2-trichloro-1,2,2-trifluoroethane; about 23 to about 29 weight percent of trans-1,2-dichloroethylene; and about 5 to about 7 weight percent of methanol and effective stabilizing amounts of 4-methoxyphenol: 1,2-butylene oxide; nitromethane; and diisopropylamine. The patent cites U.S. Pat. No. 3,960,746 which teaches that the combination of 1,1,2-trichloro-1,2,2-trifluoroethane and lower alcohols attacks reactive metals such as zinc and aluminum and thus, the composition of U.S. Pat. No. 4,803,009 includes nitromethane to retard this attack.

Other references which teach azeotrope-like compositions having the combination of 1,1,2-trichloro-1,2,2-trifluoroethane and alcohol stabilized by nitromethane to retard attack of metallic materials include U.S. Pat. No. 3,789,006 (1,1,2-trichloro-1,2,2-trifluoroethane; isopropanol; and nitromethane); U.S. Pat. No. 3,903,009 (1,1,2-trichloro-1,2,2-trifluoroethane; ethanol; and nitromethane); U.S. Pat. No. 3,960,746 (1,1,2-trichloro-1,2,2-trifluoroethane; methanol; and nitromethane); commonly assigned U.S. Pat. No. 4,062,794 (1,1,2-trichloro-1,2,2-trifluoroethane; methanol; ethanol; isopropanol; and nitromethane); commonly assigned U.S. Pat. No. 4,052,328 (1,1,2-trichloro-1,2,2-trifluoroethane; ethanol; isopropanol; and nitromethane); U.K. Pat. No. 2,066,840B (1,1,2-trichloro-1,2,2-trifluoroethane; ethanol; nitromethane; and acetone) Japanese Pat. Nos. 81-34,799 and 81-34,79B (1,1,2-trichloro-1,2,2-trifluoroethane; ethanol; nitromethane; and 3-methylpentane or 2,2-dimethylbutane or 2,3-dimethylbutane); Japanese Pat. No. 81-109,298 (1,1,2-trichloro-1,2,2-trifluoroethane; ethanol; nitromethane; and n-hexane); commonly assigned U.S. Pat. No. 4,606,841 (1,1,2-trichloro-1,2,2-trifluoroethane; ethanol; nitromethane; acetone; and hexane); and commonly assigned U.S. Pat. No. 4,683,075 (1,1,2-trichloro-1,2,2-trifluoroethane; methanol; nitromethane; acetone; and methyl acetate).

SUMMARY OF THE INVENTION

The present invention provides novel azeotrope-like compositions comprising 1,1,2-trichloro-1,2,2-trifluoroethane; 1,2-dichloroethylene; and alkanol having 3 to 7 carbon atoms. Preferably, the novel azeotrope-like compositions comprise 1,1,2-trichloro-1,2,2-trifluoroethane; 1,2-dichloroethylene; and 2-methyl-2-propanol or 3-pentanol.

Proceeding contrary to the teachings in the art that nitromethane is required to stabilize 1,1,2-trichloro-1,2,2-trifluoroethane when in combination with alcohol, we found unexpectedly that the alkanol contributes to stabilization of the 1,1,2-trichloro-1,2,2-trifluoroethane. As such, the present invention also provides a stabilized azeotrope-like composition of 1,1,2-trichloro-1,2,2-trifluoroethane; 1,2-dichloroethylene; and alkanol and effective stabilizing amounts of a lower 1,2-epoxy alkane and at least one of a lower alkoxyphenol, phosphite ester, and lower cyclic alkene.

It is an object of this invention to provide novel azeotrope-like compositions based on 1,1,2-trichloro-1,2,2-trifluoroethane which are liquid at room temperature, which will not fractionate substantially under the process of distillation or evaporation, and which are useful as solvents for use in vapor degreasing and other solvent cleaning applications including defluxing applications.

It is a further object of the present invention to provide stabilized azeotrope-like compositions of 1,1,2-trichloro-1,2,2-trifluoroethane and 1,2-dichloroethylene. It is an additional object of the present invention to provide stabilized azeotrope-like compositions of 1,1,2-trichloro-1,2,2-trifluoroethane and 1,2-dichloroethylene which minimize corrosion of metallic materials.

Other objects and advantages of the invention will become apparent from the following description.

DESCRIPTION OF THE INVENTION

Examples of alkanols having 3 to 7 carbon atoms include 1-propanol; 2-propanol; 1-butanol; 2-butanol; 2-methyl-2-propanol; 2-methyl-l-propanol; 1-pentanol; 2-pentanol; 3-pentanol; 2-methyl-l-butanol; 2-methyl-2-butanol; 3-methyl-2-butanol; 3-methyl-l-butanol; 2,2-dimethyl-l-propanol; and 3-ethyl-3-pentanol. The preferred alkanols are 2-methyl-2-propanol and 3-pentanol. The most preferred alkanol is 2-methyl-2-propanol.

Preferably, the novel azeotrope-like compositions comprise effective amounts of 1,1,2-trichloro-1,2,2-trifluoroethane; 1,2-dichloroethylene; and 2-methyl-2-propanol or 3-Pentanol. The term "effective amounts" as used herein means the amount of each component which upon combination with the other components, results in the formation of the present azeotrope-like compositions.

The dichloroethylene component may be cis-1,2-dichloroethylene; trans-1,2-dichloroethylene; and mixtures thereof.

More specifically, when the dichloroethylene component used is trans-1,2-dichloroethylene, novel azeotrope-like compositions have been discovered comprising 1,1,2-trichloro-1,2,2-trifluoroethane; trans-1,2-dichloroethylene; and 2-methyl-2-propanol which boil at about 44.5° C. ± about 0.5° C. at 760 mm Hg (101 kPa).

Preferably, novel azeotrope-like compositions comprise from about 55 to about 70 weight percent 1,1,2-trichloro-1,2,2-trifluoroethane; from about 30 to about 42 weight percent trans-1,2-dichloroethylene; and from about 0.01 to about 3.0 weight percent 2-methyl-2-propanol which boil at about 44.5° C. at 760 mm Hg (101 kPa).

More preferably, the azeotrope-like compositions of the invention comprise from about 58 to about 67 weight percent 1,1,2-trichloro-1,2,2-trifluoroethane; from about 33 to about 41 weight percent trans-1,2-dichloroethylene; and from about 0.01 to about 1.0 weight percent 2-methy 1-2-propanol.

More specifically, when the dichloroethylene component used in cis-1,2-dichloroethylene, it should be understood that the aforementioned compositional ranges for azeotrope-like compositions of 1,1,2-trichloro-1,2,2-trifluoroethane; trans-1,2-dichloroethylene; and 2-methyl-2-propanol also apply to azeotrope-like compositions of 1,1,2-trichloro-1,2,2-trifluoroethane; cis-1,2-dichloroethylene; and 2-methyl-2-propanol.

More specifically, when the dichloroethylene component used is a mixture of trans-1,2-dichloroethylene and cis-1,2-dichloroethylene, it should be understood that the aforementioned compositional ranges for azeotrope-like compositions of 1,1,2-trichloro-1,2,2-trifluoroethane; trans-1,2-dichloroethylene; and 2-methyl-2-propanol also apply to azeotrope-like compositions of 1,1,2-trichloro-1,2,2-trifluoroethane; a mixture of trans-1,2-dichloroethylene and cis-1,2-dichloroethylene; and 2-methyl-2-propanol.

More specifically, when the dichloroethylene component used is trans-1,2-dichloroethylene, novel azeotrope-like compositions have been discovered comprising 1,1,2-trichloro-1,2,2-trifluoroethane; trans-1,2-dichloroethylene; and 3-pentanol which boil at about 45.1° C. ± about 0.5° C. at 760 mm Hg (101 kPa).

Preferably, novel azeotrope-like compositions comprise from about 55 to about 70 weight percent 1,1,2-trichloro-1,2,2-trifluoroethane; from about 30 to about 42 weight percent trans-1,2-dichloroethylene; and from about 0.01 to about 3.0 weight percent 3-pentanol which boil at about 45.1° C at 760 mm Hg (101 kPa).

More preferably, the azeotrope-like compositions of the invention comprise from about 58 to about 67 weight percent 1,1,2-trichloro-1,2,2-trifluoroethane; from about 33 to about 41 weight percent trans-1,2-dichloroethylene; and from about 0.01 to about 1.0 weight percent 3-pentanol.

More specifically, when the dichloroethylene component used is cis-1,2-dichloroethylene, it should be understood that the aforementioned compositional ranges for azeotrope-like compositions of 1,1,2-trichloro-1,2,2-trifluoroethane; trans-1,2-dichloroethylene; and 3-pentanol also apply to azeotrope-like compositions of 1,1,2-trichloro-1,2,2-trifluoroethane; cis-1,2-dichloroethylene; and 3-pentanol.

More specifically, when the dichloroethylene component used is a mixture of trans-1,2-dichloroethylene and cis-1,2-dichloroethylene, it should be understood that the aforementioned compositional ranges for azeotrope-like compositions of 1,1,2-trichloro-1,2,2-trifluoroethane; trans-1,2-dichloroethylene; and 3-pentanol also apply to azeotrope-like compositions of 1,1,2-trichloro-1,2,2-trifluoroethane; a mixture of trans-1,2-dichloroethylene and cis-1,2-dichloroethylene; and 3-pentanol.

The 1,1,2-trichloro-1,2,2-trifluoroethane; 1,2-dichloroethylene; 2-methyl-2-propanol; and 3-pentanol components of the novel solvent azeotrope-like compositions of the present invention are known materials Commercially available cis-1,2-dichloroethylene and trans-1,2-dichloroethylene may be used in the present invention. It should be noted that commercially available cis-1,2-dichloroethylene may also contain trans-1,2-dichloroethylene; also, commercially available trans-1,2-dichloroethylene may also contain cis-1,2-dichloroethylene. Except for the preceding, the materials should be used in sufficiently high purity so as to avoid the introduction of adverse influences upon the solvency properties or constant-boiling properties of the system.

The boiling point of 1,1,2-trichloro-1,2,2-trifluoroethane is 47.6° C. The boiling point of trans-1,2-dichloroethylene is 47 to 49° C. The boiling point of 2-methyl-2-propanol is 89.2° C. The boiling point of 3-pentanol is 115.6° C.

All compositions within the indicated ranges, as well as certain compositions outside the indicated ranges, are azeotrope-like, as defined more particularly below.

It has been found that these azeotrope-like compositions are on the whole nonflammable liquids, i.e. exhibit no flash point when tested by the Tag Open Cup test method - ASTM D 1310-86.

From fundamental principles, the thermodynamic state of a fluid is defined by four variables: pressure, temperature, liquid composition and vapor composition, or P-T-X-Y, respectively. An azeotrope is a unique characteristic of a system of two or more components where X and y are equal at the stated P and T In practice, this means that the components of a mixture cannot be separated during distillation, and therefore are useful in vapor phase solvent cleaning as described above.

For the purpose of this discussion, azeotrope-like composition is intended to mean that the composition behaves like an azeotrope, i.e. has constant-boiling characteristics or a tendency not to fractionate upon boiling or evaporation. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is to be contrasted with non-azeotrope-like compositions in which during boiling or evaporation, the liquid composition changes to a substantial degree.

Thus, one way to determine whether a candidate mixture is "azeotrope-like" within the meaning of this invention, is to distill a sample thereof under conditions (i.e. resolution - number of plates) which would be expected to separate the mixture into its separate components. If the mixture is non-azeotrope-like, the mixture will fractionate, i.e. separate into its various components with the lowest boiling component distilling off first, and so on. If the mixture is azeotrope-like, some finite amount of a first distillation cut will be obtained which contains all of the mixture components and which is constant-boiling or behaves as a single substance. This phenomenon cannot occur if the mixture is not azeotrope-like, i.e. it does not behave like an azeotrope. Of course, upon distillation of an azeotrope-like composition such as in a vapor degreaser, the true azeotrope will form and tend to concentrate.

It follows from the above that another characteristic of azeotrope-like compositions is that there is a range of compositions containing the same components in varying proportions which are azeotrope-like or constant-boiling. All such compositions are intended to be covered by the term azeotrope-like or constant-boiling as used herein. As an example, it is well known that at differing pressures, the composition of a given azeotrope-like composition will vary at least slightly as does the boiling point of the composition. Thus, an azeotrope-like composition of A and B represents a unique type of relationship but with a variable composition depending on temperature and/or pressure. Accordingly, another way of defining azeotrope-like within the meaning of this invention is to state that mixtures of 1,1,2-trichloro-1,2,2-trifluoroethane; trans-1,2-dichloroethylene; and 2-methyl-2-propanol boil within ±0.5° C. of 44.5° C. at 760 mm Hg (101 kPa) and mixtures of 1,1,2-trichloro-1,2,2-trifluoroethane; trans-1,2-dichloroethylene; and 3-pentanol boil within ±0.5° C. of 45.1° C. at 760 mm Hg (101 kPa). As is readily understood by persons skilled in the art, the boiling point of the azeotrope-like composition will vary with the pressure.

It should be understood that the present compositions may include additional components so as to form new azeotrope-like compositions. Any such compositions are considered to be within the scope of the present invention as long as the compositions are constant-boiling or essentially constant-boiling and contain all of the essential components described herein.

The azeotrope-like compositions of the present invention are useful as solvents in a variety of vapor degreasing, cold cleaning, and solvent cleaning applications including defluxing and dry cleaning.

In the process embodiment of the invention, the stabilized azeotrope-like compositions of the invention may be used to clean solid surfaces by treating said surfaces with said compositions in any manner well known in the art such as by dipping or spraying or use of conventional degreasing apparatus.

As mentioned earlier, it is believed that 2-methyl-2-propanol or 3-pentanol does not combine with 1,1,2-trichloro-1,2,2-trifluoroethane to attack reactive metals but instead these alcohols help to prevent this reaction in the azeotrope-like composition Although the azeotrope-like composition alone is somewhat stable, the addition of a lower 1,2-epoxy alkane and at least one of a lower alkoxyphenol, phosphite ester, and lower cyclic alkene forms the present "stabilized azeotrope-like composition".

Examples of useful 1,2-epoxy alkanes having 3 to 6 carbon atoms include ethylene oxide; propylene oxide: 1,2-butylene oxide: 2,3-butylene oxide: 1,2-pentylene oxide; 2,3-pentylene oxide: 1,2-hexylene oxide; 2,3-hexylene oxide: and 3,4-hexylene oxide. The preferred lower 1,2-epoxy alkane is 1,2-butylene oxide.

Examples of useful lower alkoxyphenols include methoxyphenol, ethoxyphenol, and propoxyphenol. The preferred lower alkoxyphenol is methoxyphenol and the preferred methoxyphenOl is 4-methoxyphenol Examples of useful phosphite esters include triisodecyl phosphite; triisooctyl phosphite; triphenyl phosphite; and diisooctyl phosphite. The preferred phosphite ester is triisodecyl phosphite.

Examples of useful cyclic alkenes having 5 to 7 carbon atoms include cyclopentene, cyclohexene, and cycloheptene. The preferred lower cyclic alkene is cyclopentene.

The most preferred combination is 1,2-butylene oxide with 4-methoxyphenol.

These materials are all known materials and are commercially available. It should be noted that some commercially available trans-1,2-dichloroethylene contains from about 100 to 1,000 parts per million 4-methoxyphenol and 1,2-butylene oxide; this grade may be used in the present invention.

The term "effective stabilizing amounts" as used herein means that amount of each of the lower 1,2-epoxy alkanes, lower alkoxyphenols, phosphite esters, and lower cyclic alkenes, which in combination with the azeotrope-like composition of 1,1,2-trichloro-1,2,2-trifluoroethane, 1,2-dichloroethylene, and alkanol allows the composition to be used and stored without loss of acceptable properties.

Regardless of the azeotrope-like composition, the preferred stabilized azeotrope-like composition of the present invention contains 1,2-epoxy alkane in an amount of from about 0.01 to about 2.0 percent by weight. Regardless of the azeotrope-like composition, the Preferred stabilized azeotrope-like composition of the present invention contains at least one of a lower alkoxyphenol, phosphite ester, and lower cyclic alkene in an amount of from about 0.01 to about 0.5 percent by weight.

The alcohols in the present azeotrope-like compositions are effective in preventing the hydrolysis of the azeotrope-like composition in the presence of galvanized steel in addition to aluminum-2024, copper, and cold rolled steel. Typically, as will be explained below, when the stabilized azeotrope-like composition is in contact with metallic materials, the $Cl^-$ concentration is less than 40 parts per million. Also, the metallic surface remains shiny.

The stabilized azeotrope-like composition of the present invention may be prepared in any known manner including weighing each component and then mixing said components.

The present invention is more fully illustrated by the following non-limiting Examples.

EXAMPLE 1

These examples cOnfirm the existence of constant-boiling or azeotrope-like compositions of 1,1,2-trichloro-1,2,2-trifluoroethane; trans-1,2-dichloroethylene; and 2-methyl-2-propanol by use of an ebulliometer.

A measured amount of 1,1,2-trichloro-1,2,2-trifluoroethane was charged into an ebulliometer. Small increments of trans-1,2-dichloroethylene were then added to the 1,1,2-trichloro-1,2,2-trifluoroethane. The liquid mixture in the ebulliometer was maintained at boiling by supplemental heat Once the formation of the binary azeotrope-like composition was confirmed by constant-boiling, the ternary azeotrope-like composition was determined by adding small increments of the 2-methyl-2-propanol. The formation of a ternary azeotrope-like composition was confirmed by constant-boiling.

An azeotrope-like composition of 60 percent by weight 1,1,2-trichloro-1,2,2-trifluoroethane; 37 percent by weight trans-1,2-dichloroethylene; and 3 percent by weight 2-methyl-2-propanol boiled at about 44.5° C.

From the above examples, it is readily apparent that additional constant-boiling or essentially constant-boiling mixtures of the same components can readily be identified by anyone of ordinary skill in this art by the method described. No attempt was made to fully characterize and define the outer limits of the composition ranges which are constant-boiling. Anyone skilled in the art can readily ascertain other constant-boiling or essentially constant-boiling mixtures containing the same components

EXAMPLE 2

Example 1 was repeated except that 3-pentanol instead of 2-methyl-2-propanol was used.

An azeotrope-like composition of 60 percent by weight 1,1,2-trichloro-1,2,2-trifluoroethane; 37 percent by weight trans-1,2-dichloroethylene; and 3 percent by weight 3-pentanol boiled at about 45 1° C.

EXAMPLE 3

Example 1 is repeated for Example 3 except that cis-1,2-dichloroethylene is used instead of trans-1,2-dichloroethylene.

EXAMPLE 4

Example 1 is repeated for Example 4 except that trans-1,2-dichloroethylene containing 10 weight percent cis-1,2-dichloroethylene is used.

EXAMPLE 5

Example 1 is repeated for Example 5 except that trans-1,2-dichloroethylene containing 5 weight percent cis-1,2-dichloroethylene is used.

EXAMPLE 6

Example 1 is repeated for Example 6 except that cis-1,2-dichloroethylene containing 10 weight percent trans-1,2-dichloroethylene is used.

EXAMPLE 7

Example 1 is repeated for Example 7 except that cis-1,2-dichloroethylene containing 5 weight percent trans-1,2-dichloroethylene is used.

EXAMPLE 8

Example 2 is repeated for Example 8 except that cis-1,2-dichloroethylene is used instead of trans-1,2-dichloroethylene.

EXAMPLE 9

Example 2 is repeated for Example 9 except that trans-1,2-dichloroethylene containing 10 weight percent cis-1,2-dichloroethylene is used.

EXAMPLE 10

Example 2 is repeated for Example 10 except that trans-1,2-dichloroethylene containing 5 weight percent cis-1,2-dichloroethylene is used.

EXAMPLE 11

Example 2 is repeated for Example 11 except that cis-1,2-dichloroethylene containing 10 weight percent trans-1,2-dichloroethylene is used

EXAMPLE 12

Example 2 is repeated for Example 12 except that cis-1,2-dichloroethylene containing 5 weight percent trans-1,2-dichloroethylene is used.

EXAMPLES 13–18

In the following examples, stabilized azeotroPe-like compositions comprising 60 percent by weight 1,1,2-trichloro-1,2,2-trifluoroethane; 37 percent by weight trans-1,2-dichloroethylene; 3 percent by weight 2-methyl-2-propanol or 3-pentanol; 200 ppm 1,2-butylene oxide; and 200 ppm 4-methoxyphenol were tested for stability in the presence of metallic materials. The metallic materials included Aluminum-2024(hereinafter Al-2024), Copper(hereinafter Cu), Cold Rolled Steel(CRS), and Galvanized Steel(GS)

In each Example, the mixture of 1,1,2-trichloro-1,2,2-trifluoroethane; dichloroethylene; 4-methoxyphenol; and 1,2-butylene oxide was oversaturated with water in order to create the worse possible scenario Then, one of the alkanols listed below was added to the mixture About 125 milliliters of the water saturated five component mixture were then transferred into a 250 milliliter pyrex flask which connected to a water/glycol cooled condenser On top of the condenser, a Drierite desiccant tube was installed to prevent ambient moisture from leaking into the system.

A metal strip was placed in the middle of the liquid-vapor phases because corrosion tends to begin at the liquid-vapor interface. The water saturated five component mixture with the metal strip therein was under total reflux at its boiling temperature for seven days.

Observations were made daily The recorded changes in the metallic surface (METAL in the Tables below) such as the loss of luster (LL in the Tables below), stain, and corrosion if any are in the Tables below. The recorded coloration of the five component mixture (SOLVENT in the Tables below) and increase in viscosity of the five component mixture are also in the Tables below. In the Tables, CL means colorless, NV means nonviscous, and NC means no change.

At the end of seven days, the pH value was determined for each of the five component mixtures tested and the pH ranged from 4.8 to 6.0. The $Cl^-$concentration as determined by ion chromatography in parts per million is in the Tables below.

TABLE I

| | AL-2024 | | | |
|---|---|---|---|---|
| EXAMPLE | ALKANOL | $Cl^-$ | METAL | SOLVENT |
| 13 | 2-methyl-2-propanol | 0.03 | NC | CL/NV |
| 14 | 3-pentanol | 0.03 | NC | CL/NV |

TABLE II

| | CU | | | |
|---|---|---|---|---|
| EXAMPLE | ALKANOL | $Cl^-$ | METAL | SOLVENT |
| 15 | 2-methyl-2-propanol | 0.03 | NC | CL/NV |
| 16 | 3-pentanol | 0.02 | NC | CL/NV |

TABLE III

| | CRS | | | |
|---|---|---|---|---|
| EXAMPLE | ALKANOL | $Cl^-$ | METAL | SOLVENT |
| 17 | 2-methyl-2-propanol | 0.03 | NC | CL/NV |
| 18 | 3-pentanol | 0.05 | NC | CL/NV |

COMPARATIVE AND EXAMPLES 19–20

Performance studies were conducted wherein metal coupons were cleaned using the present stabilized azeotrope-like compositions as solvents The metal coupons were soiled with various types of oils and heated to 93° C. so as to partially simulate the temperature attained while machining and grinding in the presence of these oils The metal coupons thus treated were degreased in a three-sump vapor phase degreaser machine In this typical three-sump degreaser, condenser coils around the lip of the machine are used to condense the solvent vapor which is then collected in a sump. The condensate overflows into cascading sumps and eventually goes into the boiling sump.

The metal coupons were held in the solvent vapor and then vapor rinsed for a period of 15 seconds to 2 minutes depending upon the oils selected A short time period was selected so that the solvents could be easily compared The present azeotrope-like compositions were compared with a composition taught by U.S. Pat. No. 4,804,493: 62.4 weight percent CFC-113; 37.0 weight percent trans-1,2-dichloroethylene; 200 parts per million 4-methoxyphenol; 0.4 weight percent 1,2-butylene oxide; and 0.2 weight percent nitromethane in cleaning performance (designated as Comparative in Table IV)

The stabilized azeotrope-like composition of Example 19 is 60 weight percent CFC-113; 37 weight percent trans-1,2-dichloroethylene; 3 weight percent 2-methyl-2-propanol; 200 parts per million 1,2-butylene oxide; and 200 parts per million 4-methoxoxyphenol. The stabilized azeotrope-like composition of Example 20 is 60 weight percent CFC-113; 37 weight percent trans-1,2-dichloroethylene; 3 weight percent 3-pentanol; 200 parts per million 1,2-butylene oxide; and 200 parts per million 4-methoxyphenol.

In comparing the performances of the solvents, cleanliness testing of coupons was done by measurement of the weight change of the coupons using an analytical balance to determine the total residual materials left after cleaning The cleanliness test results are shown below in Table IV. The results show that the present stabilized azeotrope-like compositions performed equal to or better than composition of U.S. Pat. No. 4,804,493 in cleaning the various oils. The cleaning results are shown in percentage of oils removed from the surfaces

TABLE IV

| OIL | SOLVENT | WT % OIL REMOVED |
|---|---|---|
| Petroleum Based | Comparative | 100 |
| Petroleum Based | Example 19 | 100 |
| Petroleum Based | Example 20 | 100 |
| Synthetic | Comparative | 42.6 |
| Synthetic | Example 19 | 58.8 |
| Synthetic | Example 20 | 43.4 |

Having described the invention in detail and by reference to preferred embodiments thereof, it will be apparent that modifications and variations are possible without departing from the scope of the invention defined in the appended claims.

What is claimed is:

1. Azeotrope-like compositions comprising from about 55 to about 70 weight percent 1,1,2-trichloro-1,2,2-trifluoroethane; from about 30 to about 42 weight pe rcent trans-1,2-dichloroethylene; and from about 0.01 to about 3.0 weight percent 2-methyl-2-propanol which boil at about 44.5° C at 760 mm Hg.

2. The azeotrope-like compositions of claim 3 consisting essentially of from about 58 to about 67 weight percent said 1,1,2-trichloro-1,2,2-trifluoroethane; from about 33 to about 41 weight percent said trans-1,2-dichloroethylene; and from about 0.01 to about 1.0 weight percent said 2-methyl-2-propanol.

3. Azeotrope-like compositions consisting essentially of from about 55 to about 70 weight percent 1,1,2-trichloro-1,2,2-trifluoroethane; from about 30 to about 42 weight percent trans-1,2-dichloroethylene; and from about 0.01 to about 3.0 weight percent 3-pentanol which boil at about 45.1° C. at 760 mm Hg.

4. The azeotrope-like compositions of cliam 8 consisting essentially of from about 58 to about 67 weight percent said 1,1,2-trichloro-1,2,2-trifluoroethane; from about 33 to about 41 weight percent said trans-1,2-dichloroethylene; and from about 0.01 to about 1.0 weight percent said 3-pentanol.

5. Stabilized azeotrope-like compositions consisting essentially of the azeotrope-like compositions of claim 3 and effective stabilizing amounts of a lower 1,2-epoxy alkane and at least one of a lower alkoxyphenol, phosphite ester, and lower cyclic alkene.

6. Stabilized azeotrope-like compositions consisting of essentially of the azeotrope-like compositions of claim 5 and effective stabilizing amounts of a lower 1,2-epoxy alkane and at least one of a lower alkoxyphenol, phosphite ester, and lower cyclic alkene.

7. Stabilized azeotrope-like compositions consisting essentially of the azeotrope-like compositions of claim 8 and effective stabilizing amounts of a lower 1,2-epoxy alkane and at least one of a lower alkoxyphenol, phosphite ester, and lower cyclic alkene.

8. Stabilized azeotrope-like compositions comprising the azeotrope-like compositions of claim 10 and effective stabilizing amounts of a lower 1,2-epoxy alkane and at least one of a lower alkoxyphenol, phosphite ester, and lower cyclic alkene.

9. A method of cleaning a solid surface which comprises treating said surface with said azeotrope-like composition of claim 3.

10. A method of cleaning a solid surface which comprises treating said surface with said azeotrope-like composition of claim 5.

11. A method of cleaning a solid surface which comprises treating said surface with said azeotrope-like composition of claim 8.

12. A method of cleaning a solid surface which comprises treating said surface with said azeotrope-like composition of claim 10.

* * * * *